US010910795B2

(12) United States Patent
Dorsch et al.

(10) Patent No.: US 10,910,795 B2
(45) Date of Patent: Feb. 2, 2021

(54) ARRESTER FOR SURGE PROTECTION

(71) Applicant: TDK Electronics AG, Munich (DE)

(72) Inventors: Eduard Dorsch, Dallgow (DE); Frank Werner, Berlin (DE)

(73) Assignee: TDK ELECTRONICS AG, Munich (DE)

( * ) Notice: Subject to any disclaimer, the term of this patent is extended or adjusted under 35 U.S.C. 154(b) by 194 days.

(21) Appl. No.: 16/074,767

(22) PCT Filed: Jan. 25, 2017

(86) PCT No.: PCT/EP2017/051562
§ 371 (c)(1),
(2) Date: Aug. 1, 2018

(87) PCT Pub. No.: WO2017/133951
PCT Pub. Date: Aug. 10, 2017

(65) Prior Publication Data

US 2019/0052064 A1 Feb. 14, 2019

(30) Foreign Application Priority Data

Feb. 1, 2016 (DE) ..... 10 2016 101 728

(51) Int. Cl.

| | |
|---|---|
| ***H01T 1/10*** | (2006.01) |
| ***H01T 4/12*** | (2006.01) |
| ***H01T 4/10*** | (2006.01) |
| ***H01T 1/12*** | (2006.01) |
| ***H01T 1/14*** | (2006.01) |
| ***H01T 1/24*** | (2006.01) |

(52) U.S. Cl.
CPC ..... *H01T 1/10* (2013.01); *H01T 1/12* (2013.01); *H01T 1/14* (2013.01); *H01T 1/24* (2013.01); *H01T 4/10* (2013.01); *H01T 4/12* (2013.01)

(58) Field of Classification Search
CPC .... H01T 1/02; H01T 1/10; H01T 1/12; H01T 1/14; H01T 1/24; H01T 4/10; H01T 4/12; H01J 17/04; H01J 61/04; H01J 17/26; H01J 61/28
See application file for complete search history.

(56) References Cited

U.S. PATENT DOCUMENTS 3,780,350 A 12/1973 Sanger et al.
4,241,374 A * 12/1980 Gilberts ..... H01T 1/14 337/32
4,644,441 A * 2/1987 Igarashi ..... H01T 4/12 361/120
5,061,877 A 10/1991 Akanuma
(Continued)

FOREIGN PATENT DOCUMENTS

CN 101233659 A 7/2008
CN 101330196 A 12/2008
(Continued)

*Primary Examiner* — Adolf D Berhane
(74) *Attorney, Agent, or Firm* — Slater Matsil, LLP

(57) ABSTRACT

An arrester for surge protection is disclosed. In an embodiment, an arrester for surge protection includes a first electrode, a second electrode, a discharge chamber for enabling an electrical discharge between the electrodes in an event of an overvoltage and an insulator forming an inner wall of the arrester, wherein the inner wall has a projection.

20 Claims, 1 Drawing Sheet

(56) References Cited

U.S. PATENT DOCUMENTS

| | | | | |
|---|---|---|---|---|
| 5,391,961 | A | 2/1995 | Tsuchiya et al. | |
| 7,932,673 | B2 | 4/2011 | Schleimann-Jensen et al. | |
| 8,080,927 | B2 | 12/2011 | Boy et al. | |
| 8,169,145 | B2 | 5/2012 | Boy et al. | |
| 2007/0064372 | A1* | 3/2007 | Loader | H01T 1/14<br>361/118 |
| 2017/0077678 | A1* | 3/2017 | Dorsch | H01T 1/20 |

FOREIGN PATENT DOCUMENTS

| | | | |
|---|---|---|---|
| DE | 3218948 | A1 | 11/1983 |
| DE | 8611043 | U1 | 10/1987 |
| DE | 4309610 | A1 | 10/1993 |
| DE | 102005036265 | A1 | 2/2007 |
| DE | 102008029094 | A | 1/2009 |
| EP | 1995837 | A2 | 11/2008 |
| JP | H05084007 | U | 11/1993 |
| JP | 2003100417 | A | 4/2003 |

* cited by examiner

ARRESTER FOR SURGE PROTECTION

This patent application is a national phase filing under section 371 of PCT/EP2017/051562, filed Jan. 25, 2017, which claims the priority of German patent application 10 2016 101 728.0, filed Feb. 1, 2016, each of which is incorporated herein by reference in its entirety.

TECHNICAL FIELD

An arrester for surge protection is specified. In particular, a gas-filled arrester is disclosed.

BACKGROUND

A surge arrester is known, for example, from German Patent No. DE 10 2008 029 094 A1. The disclosure describes providing an arrester with a stepped configuration in the ceramic in order to lengthen the wall-side insulation clearance between the electrodes.

SUMMARY OF THE INVENTION

Embodiments provide an arrester having improved properties.

In an embodiment an arrester for surge protection includes a first electrode and a second electrode. The electrodes each comprise an electrically conductive material. The arrester further comprises a discharge chamber for enabling an electrical discharge between the electrodes in the event of an overvoltage. Consequently, in the event of an overvoltage, a discharge, in particular an arc discharge, between the electrodes is intended to take place in the discharge chamber. The discharge chamber is formed, for example, by a region between the electrodes, in particular by a region in which the distance between the electrodes is particularly small. The discharge chamber can be filled with a gas, in particular a noble gas.

The first electrode can have a different geometry than the second electrode. By way of example, the first electrode is configured in a pin-shaped fashion and the second electrode is configured with the geometry of a hollow cylinder. The first electrode projects, for example, into the hollow space of the second electrode. The first electrode can also have the same geometry as the second electrode.

The arrester further comprises an insulator. By way of example, the insulator comprises a ceramic. The insulator forms an inner wall of the arrester. By way of example, the arrester has the shape of a cylinder. The insulator forms, for example, the lateral surface of the cylinder. The electrodes are galvanically isolated from one another by the insulator. By way of example, an insulation space is formed between the arrester and the electrodes. The insulation space can be filled with a gas.

In the event of a discharge between the electrodes, an evaporation of electrode material can occur. The discharge chamber has an exit opening, for example, through which the evaporated electrode material can leave the discharge chamber. The evaporated electrode material can then deposit on the inner wall of the insulator. This leads to a reduction of the insulation resistance of the insulator. In particular, the establishment of an electrically conductive bridge between the electrodes via the inner wall and thus impermissibly high leakage currents can occur.

The inner wall of the insulator has a projection. A sufficient insulation resistance of the insulator is intended to remain ensured by means of the projection. The projection is configured, for example, in such a way that it obstructs a contamination of at least one part of the inner wall by evaporated electrode material emerging from the discharge chamber. The projection is intended to obstruct in particular the formation of an electrically conductive path that galvanically connects the electrodes to one another. The projection, for example, also leads to the lengthening of a wall-side insulation clearance between the electrodes. In this case, the wall thickness of the insulator is preferably not reduced by the projection, with the result that the mechanical stability of the arrester is maintained.

By way of example, at least one of the electrodes extends along a direction, in particular a height direction, of the arrester into the discharge chamber, wherein the projection protrudes perpendicularly to this direction.

In one embodiment, the inner wall has a first wall region and a second wall region. The first and second wall regions extend, for example, parallel to the height direction of the arrester. By way of example, the inner wall is subdivided into the two wall regions by the projection. The first wall region is situated before the projection, coming from the discharge chamber, and the second wall region is situated behind the projection, coming from the discharge chamber. If evaporated electrode material arises in the discharge chamber, the evaporated electrode material thus reaches firstly the first wall region, then the projection and then the second wall region.

In this case, the projection forms in particular an obstruction for the evaporated electrode material, such that only part of the evaporated electrode material that passes as far as the projection also passes to the second wall region via the projection. By way of example, the projection narrows a path for the evaporated electrode material. In particular, the projection can form a constriction of the insulation space. Preferably, the evaporated electrode material has to surmount the projection in order to pass to the second wall region. In other words, for the evaporated electrode material there is preferably no path to the second wall region which does not lead via the projection.

In one embodiment, the projection is configured in a circumferentially extending fashion. In the case of a cylindrical arrester, the projection extends circumferentially around the inner wall of the insulator at a fixed height, for example.

In one embodiment, the height of the projection is less than the height of the inner wall of the arrester. In particular, the height of the projection is significantly less than the height of the inner wall. Consequently, the projection constitutes only a local change in the geometry of the inner wall. In particular, the projection only locally constricts the insulation space, such that the insulation space overall is only slightly reduced in size.

In one embodiment, the projection is arranged in a manner offset relative to half the height of the inner wall. By way of example, one of the wall regions is larger than the other wall region. In particular, the first wall region can be larger than the second wall region. The second wall region should however be large enough to be able to effectively prevent the formation of electrically conductive paths.

In one embodiment, the projection is arranged in relation to the exit opening in such a way that evaporated electrode material does not impinge frontally on the projection. In this case, the shielding effect of the projection could be reduced. In one embodiment, the projection is arranged in a manner offset with respect to a height position of an exit opening of the discharge chamber.

The projection is arranged, for example, laterally alongside one of the electrodes. In particular, only a gas-filled interspace is situated between the projection and said electrode. The electrode has an end arranged within the discharge chamber and an end opposite thereto. The projection is, for example, further away from the end of the electrode that is arranged within the discharge chamber by comparison with the end opposite thereto. In this way it is possible to prevent the vapor deposition on the inner wall from being concentrated on an excessively small region before the projection.

In one embodiment, the projection is configured in an edge-shaped fashion. By way of example, the underside of the projection is configured in an edge-shaped fashion. In this case, underside denotes that side of the projection which adjoins the second wall region. By way of example, the underside forms with the second wall region an angle of less than 90°. In this way, the projection forms a shadow space in which the contamination is reduced further. Said shadow space comprises, for example, the lower edge of the projection and an adjoining part of the second wall region.

BRIEF DESCRIPTION OF THE DRAWINGS

The subjects described here are explained in greater detail below on the basis of schematic exemplary embodiments.

In the figures.

DETAILED DESCRIPTION OF ILLUSTRATIVE EMBODIMENTS

Figure 1A:
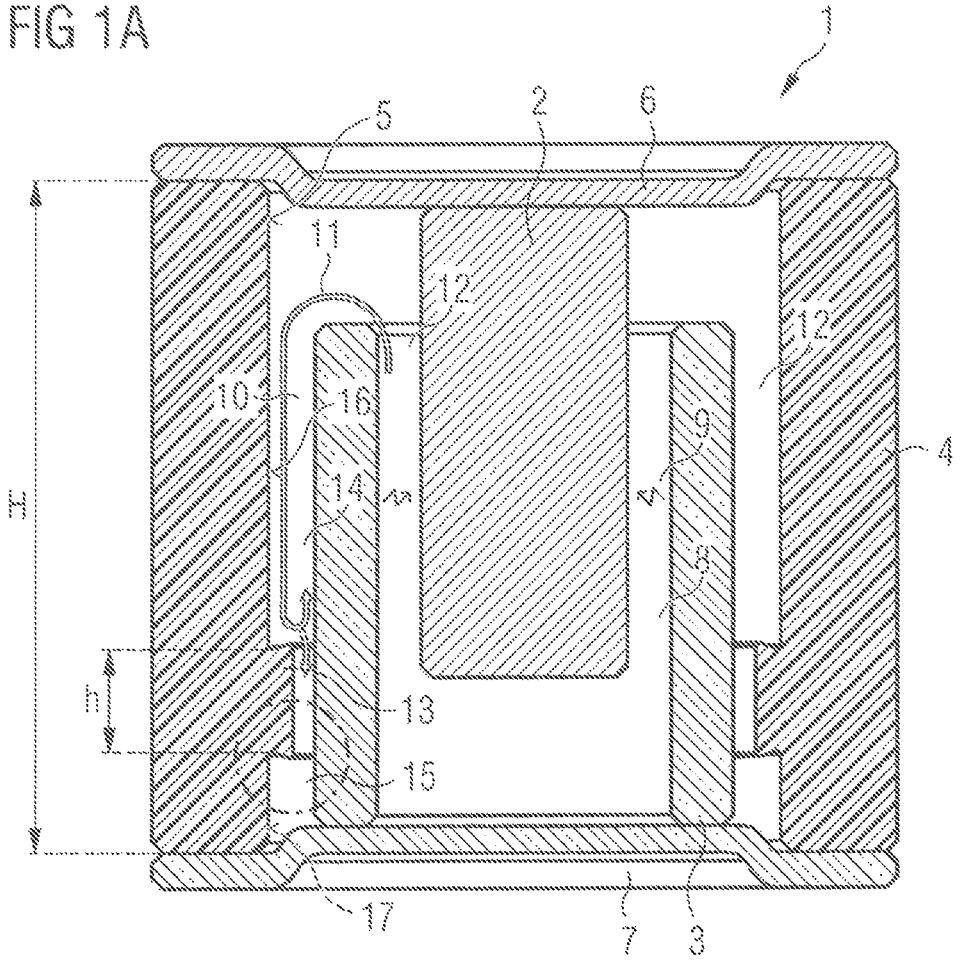
FIG. 1A shows an embodiment of an arrester for surge protection in a sectional diagram.

FIG. 1A shows an arrester 1 for surge protection in a sectional diagram. The arrester 1 has, for example, a cylindrical design.

The arrester 1 comprises a first electrode 2 and a second electrode 3. The electrodes 2, 3 each comprise an electrically conductive material. By way of example, the electrodes 2, 3 comprise copper. The first electrode 2 projects into the interior of the arrester 1, for example, in a pin-shaped fashion. The second electrode 3 projects into the interior of the arrester 1, for example, in the form of a hollow cylinder and partly surrounds the first electrode 2.

The arrester 1 comprises an insulator 4. The insulator 4 comprises an insulating material, for example, ceramic or glass. The insulator 4 forms, for example, the lateral surface of the arrester 1. The insulator 4 forms an inner wall 5 of the arrester 1.

The arrester 1 additionally comprises a first contact electrode 6, which is electrically conductively connected to the first electrode 2, and a second contact electrode 7, which is electrically conductively connected to the second electrode 3. The contact electrodes 6, 7 form, for example, the top and bottom surfaces of the arrester 1.

The arrester 1 is, for example, hermetically sealed toward the outside. The arrester 1 can be filled with a gas, in particular a noble gas.

The arrester 1 comprises a discharge chamber 8, in which a discharge 9, in particular an arc discharge, between the electrodes 2, 3 occurs in the event of an activation voltage being exceeded. The discharge chamber 8 is formed between the electrodes 2, 3, in particular in a region in which the distance between the electrodes 2, 3 is the smallest.

The electrodes 2, 3 are spaced apart from the inner wall 5. The second electrode 3 is situated closer to the inner wall 5 than the first electrode 2. An insulation space 10 is situated between the inner wall 5 and the electrodes 2, 3. The insulation space 10 is gas-filled, for example.

Particularly in the event of repeated surge current loadings, electrode material from the electrodes 2, 3 can evaporate during a discharge 9. This involves copper particles, for example. The evaporated electrode material 11 leads, for example, to a contamination of the ionized gas. The evaporated electrode material 11 can emerge from the discharge chamber 8 through an exit opening 12 and advance to the insulation space 1*o*. Vapor deposition with electrode material 11 on the inner wall 5 of the insulator 4 can occur in this case. This can lead to a reduction of the insulation resistance of the inner wall 5 and thus to a functional deterioration. In particular, the vapor deposition can lead to the formation of an electrically conductive bridge between the electrodes 2, 3 via the inner wall 5. By way of example, impermissibly high leakage currents during operation at rated AC voltage can occur in this case.

In order to maintain a sufficient insulation resistance, the inner wall 5 has a projection 13. The projection 13 is part of the insulator 4 and is thus composed of insulating material. The projection 13 is configured, for example, in a circumferentially extending fashion along the inner wall 5. By way of example, the projection 13 is ring-shaped. The projection 13 projects into the insulation space 10. By way of example, the projection 13 is situated in the insulation space 10 between the insulator 4 and the second electrode 3.

The height h of the projection 13, i.e., the extent of the projection 13 in a direction from a contact electrode 6 to the opposite contact electrode 7, is significantly less than the total height H of the inner wall 5. Consequently, the gas volume in the insulation space 10 is only slightly reduced by the projection 13. By way of example, the height h of the projection 13 is less than or equal to one quarter of the height H of the inner wall 5.

The projection 13 is arranged in a manner offset with respect to half the height of the inner wall 5. Consequently, the projection 13 is not arranged centrally at the inner wall 5. Furthermore, the projection 13 is not arranged at the level of the exit opening 12.

The projection 13 subdivides the insulation space 10 into a first spatial region 14 and a second spatial region 15. The first spatial region 14 is reached first by the evaporated electrode material 11 emerging from the discharge chamber 8. The second spatial region 15 is situated behind the first spatial region 14 and behind the projection 13, coming from the discharge chamber 8. The second spatial region 15 is, for example, significantly smaller than the first spatial region 14.

The projection 13 forms a local constriction of the insulation space 10. As a result, the advance of the evaporated electrode material 11 into the second spatial region 15 is obstructed by the projection 13, such that only a reduced amount of the evaporated electrode material 11 passes into the second spatial region 15. The advance of the evaporated electrode material 11 into the first spatial region 14 is not obstructed.

The projection 13 likewise subdivides the inner wall 5 into a first wall region 16 and into a second wall region 17. The second wall region 17 is situated behind the projection 13, coming from the discharge chamber 8, and is thus shaded by the projection 13. This obstructs the vapor deposition on the second wall region 17, with the result that a sufficient insulation resistance is maintained. The vapor deposition on the first wall region 16 is not obstructed. The vapor deposition on the first wall region 16 can even be intensified somewhat by the projection 13. The first wall region 16 and the second wall region 17 are arranged parallel to the height direction of the arrester 1. The second wall region 17 is significantly smaller than the first wall region 16.

In addition to the reduction of the vapor deposition on the second wall region 17, the projection 13 lengthens the wall-side insulation clearance between the electrodes 2, 3. In this case, the wall thickness of the insulator 4 is not reduced by the projection 13, with the result that the stability of the insulator 4 to withstand mechanical loading during the current pulse is maintained.

The projection 13 is arranged laterally alongside the second electrode 3. The projection 13 is further away from the end of the second electrode 3 that is arranged within the discharge chamber 8 by comparison with the end opposite thereto, which adjoins the second contact electrode 7. By way of example, the distance between the projection 13 and the end of the second electrode 3 that is arranged within the discharge chamber 8 has a magnitude at least double the distance with respect to the end adjoining the second contact electrode 7. The distance is defined, for example, as a height difference between a central plane through the projection 13 and the respective end of the electrode 3. Such a positioning of the projection 13 makes it possible to prevent the vapor deposition on the inner wall from being concentrated on an excessively small region before the projection.

Figure 1B:
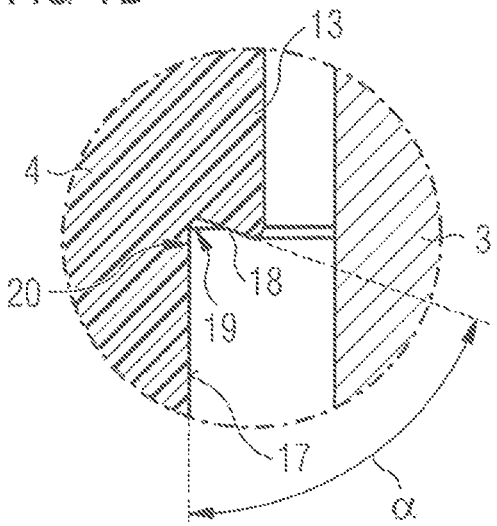
FIG. 1B shows an enlarged detail from the embodiment according to FIG. 1A.

FIG. 1B shows an enlarged detail view of a region of the arrester 1. The region shown is marked by a circle in FIG. 1A.

The projection 13 is configured in an edge-shaped fashion. In particular, the projection 13 has an edge 19 at its underside 18. In this case, the underside 18 of the projection 13 forms with the second wall region 17, for example, an acute angle $\alpha$, i.e., an angle of less than 90°. By way of example, the angle $\alpha$ is less than 80°. By way of example, the angle $\alpha$ is less than 80° and greater than 30°. The angle $\alpha$ can also be less than or equal to 90°.

A top side of the projection 13 is be configured, for example, in a manner corresponding to the underside 18 and can form an acute angle in particular with the first wall region 16. The geometry of the projection 13 can also be referred to as step-shaped. In this case, the projection 13 forms a first step with respect to the first wall region 16 and a second step with respect to the second wall region 17.

As a result of the edge-shaped geometry of the projection 13, by way of example a shadow space 20 is formed behind the projection 13. The vapor deposition is additionally reduced once again in the shadow space 20. In particular, the underside 18 of the projection 13 and an adjoining part of the second wall region lie in the shadow space 20.

The description of the subjects specified here is not restricted to the individual specific embodiments. Rather, the features of the individual embodiments can be combined—insofar as technically expedient—arbitrarily with one another.

The invention claimed is:

1. An arrester for surge protection comprising:
a first electrode;
a second electrode;
a discharge chamber for enabling an electrical discharge between the electrodes in an event of an overvoltage; and
an insulator forming an inner wall of the arrester,
wherein the inner wall has a projection,
wherein the inner wall is subdivided by the projection into a first wall region and a second wall region,
wherein the projection has an underside adjoining the second wall region, and
wherein the underside forms with the second wall region an angle $\alpha$ of less than 90°.

2. The arrester according to claim 1, wherein the projection is configured for obstructing a contamination of at least one part of the inner wall by an evaporated electrode material emerging from the discharge chamber.

3. The arrester according to claim 1, wherein the first wall region is situated before the projection, coming from the discharge chamber, and the second wall region is situated behind the projection, coming from the discharge chamber.

4. The arrester according to claim 1, wherein the projection is configured in a circumferentially extending fashion.

5. The arrester according to claim 1, wherein a height of the projection is less than a height of the inner wall.

6. The arrester according to claim 1, wherein the projection is arranged in a manner offset with respect to half a height of the inner wall.

7. The arrester according to claim 1, wherein the discharge chamber has an exit opening, from which evaporated electrode material can emerge from the discharge chamber, and wherein the projection is arranged offset with respect to a height position of the exit opening.

8. The arrester according to claim 1, wherein the projection is configured in an edge-shaped fashion.

9. The arrester according to claim 1, wherein the first electrode has a different geometry than the second electrode.

10. The arrester according to claim 1, wherein the first electrode is configured in a pin-shaped fashion and the second electrode is configured in form of a hollow cylinder.

11. The arrester according to claim 1, wherein the projection is arranged laterally alongside one of the electrodes, wherein the one electrode has an end that is arranged within the discharge chamber and an opposite end thereto, and wherein the projection is further away from the end of the one electrode that is arranged within the discharge chamber than from the opposite end.

12. The arrester according to claim 11, wherein a distance between the projection and the end of the one electrode that is arranged within the discharge chamber has a magnitude at least double the distance between the projection and the opposite end of the one electrode.

13. The arrester according to claim 1, wherein at least one of the electrodes extends along a height direction of the arrester into the discharge chamber, and wherein the projection protrudes perpendicularly to a height direction of the arrester.

14. The arrester according to claim 1, wherein the discharge chamber has an exit opening configured to evaporate electrode material from the discharge chamber.

15. An arrester for surge protection comprising:
a first electrode;
a second electrode;
a discharge chamber for enabling an electrical discharge between the electrodes in an event of an overvoltage; and
an insulator forming an inner wall of the arrester,
wherein the inner wall has a projection,
wherein the projection is arranged laterally alongside one of the electrodes,
wherein the one electrode has an end that is arranged within the discharge chamber and an opposite end thereto, wherein the projection is further away from the end of the one electrode that is arranged within the discharge chamber than from the opposite end, and wherein a distance between the projection and the end of the one electrode that is arranged within the discharge chamber has a magnitude at least double the distance between the projection and the opposite end of the one electrode.

16. The arrester according to claim 15, wherein the projection is configured in a circumferentially extending fashion.

17. The arrester according to claim 15, wherein a height of the projection is less than a height of the inner wall.

18. The arrester according to claim 15, wherein the first electrode has a different geometry than the second electrode.

19. The arrester according to claim 15, wherein the first electrode is configured in a pin-shaped fashion and the second electrode is configured in form of a hollow cylinder.

20. The arrester according to claim 15, wherein the discharge chamber has an exit opening configured to evaporate electrode material from the discharge chamber, and wherein the projection is arranged offset with respect to a height position of the exit opening.

* * * * *